US005947131A

United States Patent [19]

Kim

[11] Patent Number: 5,947,131

[45] Date of Patent: Sep. 7, 1999

[54] APPARATUS AND METHOD FOR REMOVING NAIL TIPS

[76] Inventor: Dae Jin Kim, 67-20 230th St. #2-C, Bayside, N.Y. 11364

[21] Appl. No.: 09/183,471

[22] Filed: Oct. 30, 1998

Related U.S. Application Data

[60] Provisional application No. 60/064,144, Oct. 31, 1997.

[51] Int. Cl.[6] ..... A45D 29/18

[52] U.S. Cl. ..... 132/200; 132/74.5; 4/622

[58] Field of Search ..... 132/73, 73.5, 73.6, 132/74.5, 200; 4/541.1, 622; 601/2

[56] References Cited

U.S. PATENT DOCUMENTS

| | | | |
|---|---|---|---|
| 2,970,073 | 1/1961 | Prange | 601/2 |
| 3,809,997 | 5/1974 | Balamuth et al. | 601/2 |
| 4,180,884 | 1/1980 | Hess et al. . | |
| 4,255,826 | 3/1981 | Boyd . | |
| 4,307,738 | 12/1981 | Barns | 132/74.5 |
| 4,321,936 | 3/1982 | Chaconas . | |
| 4,441,487 | 4/1984 | Daugherty et al. . | |
| 4,474,195 | 10/1984 | Warner . | |
| 4,510,954 | 4/1985 | Miller . | |
| 5,065,778 | 11/1991 | Terrell | 132/74.5 |
| 5,185,900 | 2/1993 | Warner et al. | 132/73.6 |
| 5,339,804 | 8/1994 | Kemp | 601/2 |
| 5,388,597 | 2/1995 | Smith et al. . | |
| 5,609,166 | 3/1997 | Walker | 132/73 |

FOREIGN PATENT DOCUMENTS

| | | | |
|---|---|---|---|
| 2263722 | 10/1975 | France | 132/73.6 |

OTHER PUBLICATIONS

"Ultrsonic Cleaning Equipment Currently in Use in Japan", Japan Electronic Engineering, No. 54, pp. 28–34, May 1971.

*Primary Examiner*—Todd E. Manahan
*Attorney, Agent, or Firm*—Baker & Botts

[57] ABSTRACT

A nail tip removal apparatus includes a cup for holding nail tip removal solution. A transducer is mounted on the bottom of the cup to impart vibrations to the solution to promote penetration of the solution to soften the nail tip adhesive.

8 Claims, 3 Drawing Sheets

APPARATUS AND METHOD FOR REMOVING NAIL TIPS

CROSS REFERENCE TO RELATED APPLICATION

This application claims priority of provisional application Ser. No. 60/064,144 filed Oct. 31, 1997.

BACKGROUND OF INVENTION

This invention relates to removing nail tips. Presently, removal of nail tips requires soaking in an acetone-based removal solution. This process is time consuming and unpleasant. In the process there is a tendency to apply mechanical force for removal, which can be painful.

It is an object of the invention to provide an improved apparatus and method for nail tip removal.

SUMMARY OF THE INVENTION

In accordance with the invention there is provided a nail tip removal apparatus comprising a cup for holding a nail removal solution. There is further provided an ultrasonic transducer affixed to the underside of the cup for providing ultrasonic vibrations thereto. A circuit for driving said transducer is also provided.

In accordance with the invention there is provided a method for removing nail tips comprising immersing the tips in a nail tip removal solution, providing ultrasonic vibrations to the solution to agitate the solution and maintain the solution at a temperature slightly above room temperature, and manipulating the nail tips against a surface.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
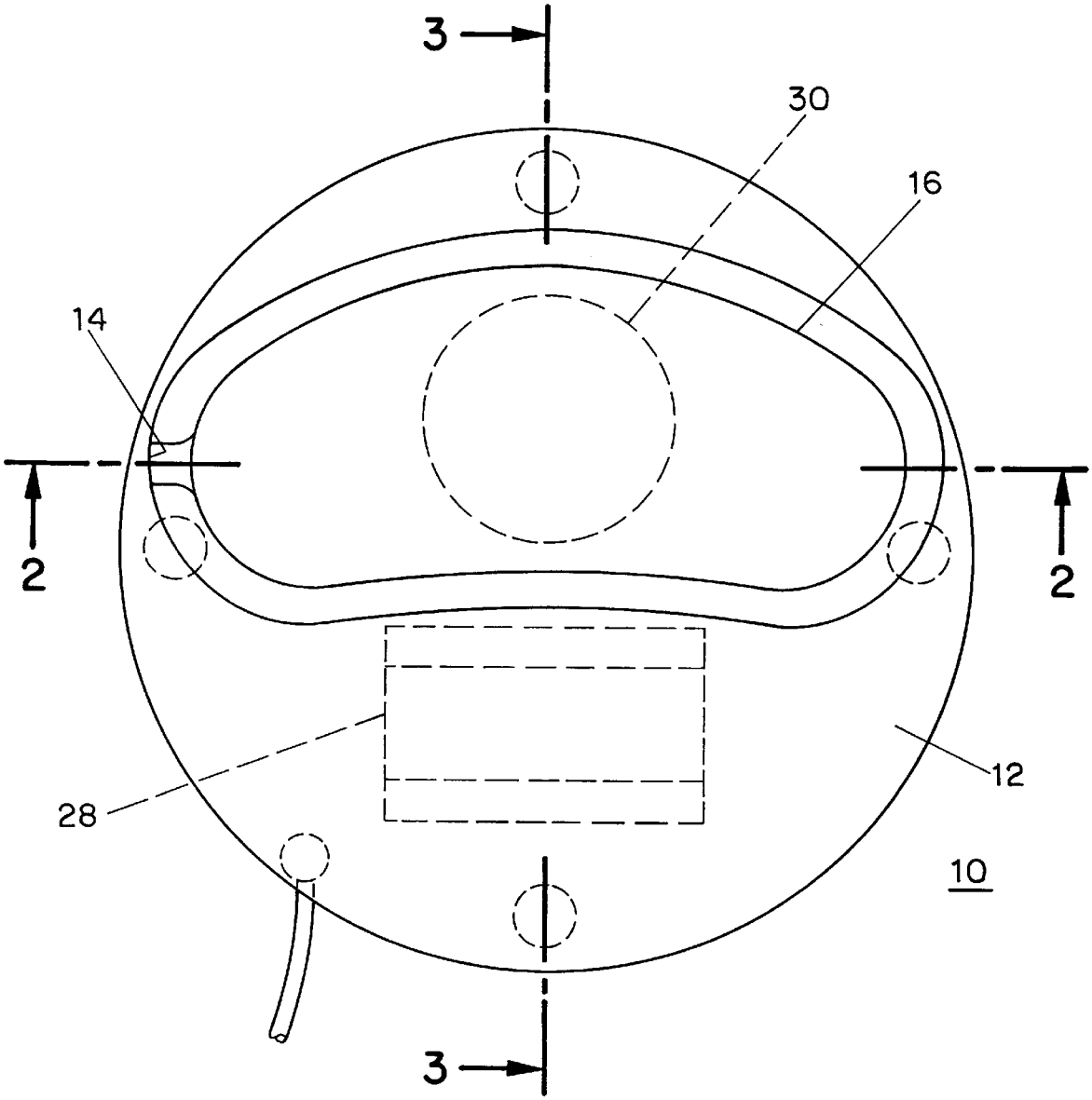
FIG. 1 is a top view of a nail tip removal apparatus in accordance with the present invention.
Figure 2:
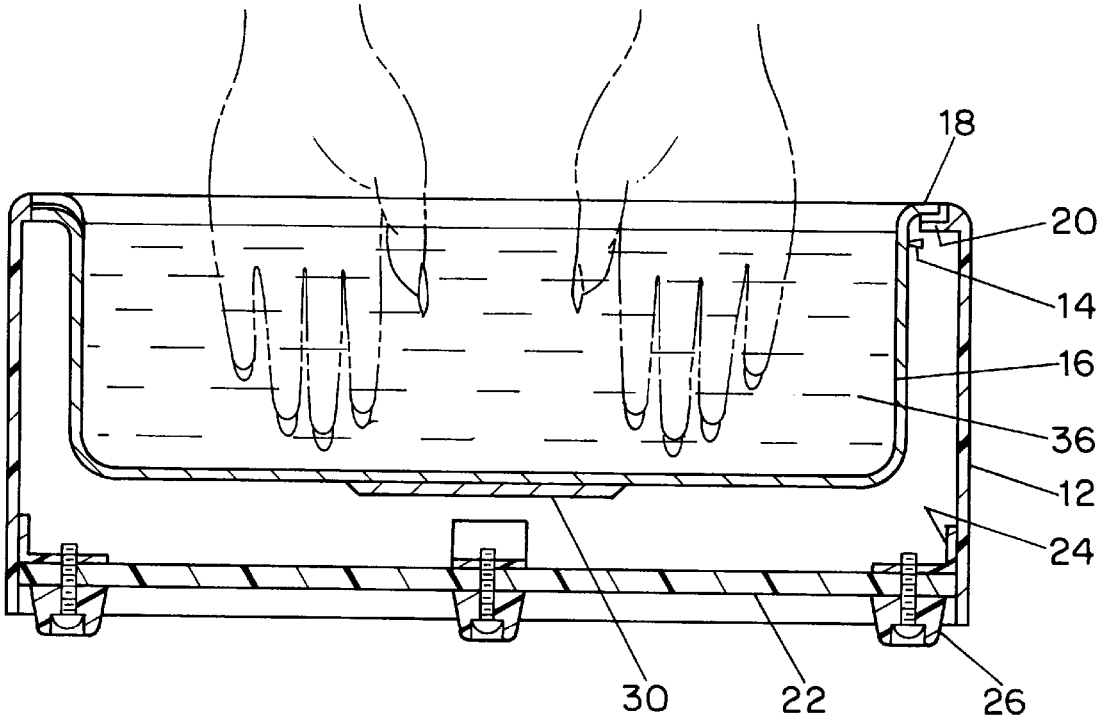
FIG. 2 is a longitudinal cross section thereof.

Referring to the drawings a nail tip removal apparatus 10 includes an outer housing 12 which is generally circular in horizontal profile having a diameter of about 200 mm and made of PVC plastic. The upper surface of housing 12 is flat on one side and includes an opening 14 into which a kidney shaped soaking cup 16 or 39 is received. Cup 16 has a peripheral flange 18 that engages and rests upon a corresponding flange 20 formed around the inner edge of opening 14 in housing 12 such that the soaking cup 16 mounts removably as seen in FIG. 2. In an alternate embodiment, shown in FIG. 4, soaking cup 39 is mounted in a groove 37 on the underside of housing 12 and sealed with sealant 38 such that cup 39 is mounted integrally. The preferred sealant includes KE45.

Figure 3:
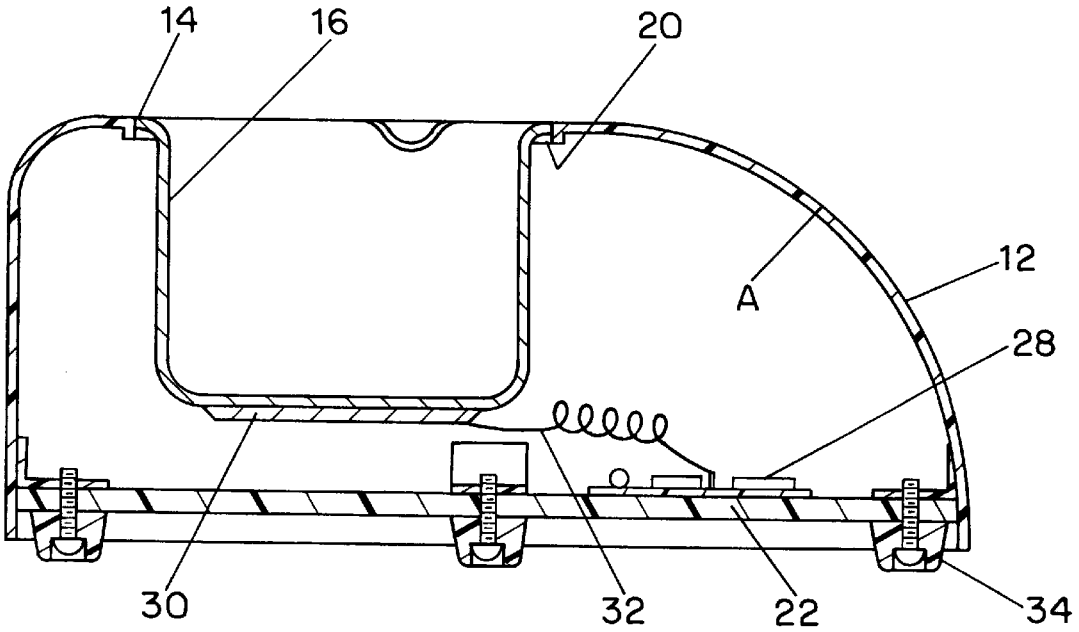
FIG. 3 is a transverse cross section thereof.

The portion of housing 12 away from opening 14 is circular in vertical cross-section as seen in FIG. 3. The radius A of this portion is about 80 mm and the portion provides a comfortable resting position for palms and heels of the hands of the user.

Figure 4:
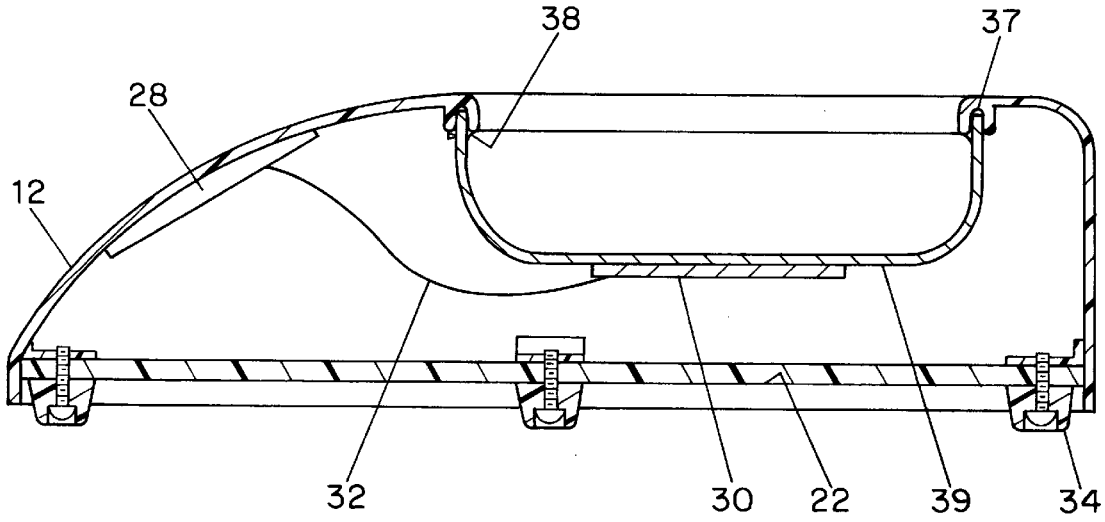
FIG. 4 is a transverse cross-section of an alternate embodiment of the nail tip removal apparatus of the present invention.

Cup 16 and cup 39 are approximately 75 mm wide, 184 mm long and 60 mm deep and are preferably made of stainless steel to resist corrosion and to facilitate cleaning. On the bottom surface of cup 16 and 39 there is mounted an ultrasonic transducer 30 to impart ultrasonic vibrations to the solution in cup 16 and 39. A driving circuit 28 for transducer 30 is mounted on a lower cover 22, as seen in FIG. 3, or preferably on the underside of the circular portion of housing 12, as seen in FIG. 4, to minimize the possibility of nail tip removal solution reaching circuit 28. Lower cover 22 is also provided with support legs 34. A wire lead 32 connects transducer 30 to circuit board 28, and is provided with sufficient length to enable cup 16 to be removed from housing 12 for cleaning. Transducer 30 is driven with about 50 watts of primary power and, in addition to providing vibration, imparts sufficient heat to maintain an acetone-based nail solution in cup 10 or cup 39 at a temperature slightly above room temperature, for example approximately 100–110° F. The frequency of vibrations is 41 KHz.

In a variation of the invention, a corrugated surface 36 may be provided as an inserted plate in cup 16 and 39. This provides an irregular surface against which the user can gently work the nail tips to promote removal. Alternate to an inserted plate, a portion of the cup bottom may be provided with corrugations.

In using the apparatus of the invention, cup 16 is mounted into housing 12 and provided with an appropriate amount of acetone based or other nail tip removal solution. Alternately, an appropriate amount of acetone based or other nail tip removal solution is provided to integrally mounted cup 39. Ultrasonic signals are provided to transducer 30 to impart vibrations to the solution and a small amount of heat to maintain slightly above room temperature. It has been found that the use of ultrasonic waves provides rapid heating of the solution, as compared, e.g. to immersion of the cup in warm water. The user rests the palm or heel of the hands on the curved portion of housing 12 with the nails and tips immersed in the solution. While soaking, gentle playing of the tip against the flat or corrugated bottom of cup 16 or cup 39 promotes removal.

While there have been described what are believed to be the preferred embodiments of the invention, those skilled in the art will recognize that other changes and modifications may be made thereto without departing from the spirit of the invention, and it is intended to claim all such changes and modifications as fall within the true scope of the invention.

I claim:

1. A nail tip removal apparatus comprising a housing, a cup within said housing, said housing having an opening in an upper surface for providing access to said cup, at least a portion of said upper surface of said housing adjacent the opening being rounded in vertical profile, an ultrasonic transducer mounted on said cup for imparting ultrasonic vibrations to fluid in said cup and a circuit for driving said transducer.

2. A nail tip removal apparatus as specified in claim 1 wherein said cup has an upper peripheral flange for resting on an interior flange surrounding an opening on an upper surface of said housing.

3. A nail tip removal apparatus as specified in claim 1 wherein said cup is mounted in a groove surrounding the underside of an opening on an upper surface of said housing.

4. A nail tip removal apparatus as specified in claim 1 wherein said cup is kidney-shaped.

5. A nail tip removal apparatus as specified in claim 1 wherein said cup is mounted in a flat portion of an upper surface of said housing and wherein remaining portions of said upper surface are rounded in vertical profile for providing a resting surface for the hands of a user.

6. A nail removal apparatus as specified in claim 1 wherein said cup is mounted in a groove surrounding the underside of an opening on an upper surface of said housing and wherein remaining portions of said upper surface are rounded in vertical profile for providing a resting surface for the hands of a user.

7. A nail tip removal apparatus as specified in claim 1 wherein said cup is provided with a corrugated bottom surface.

8. A method of removing nail tips comprising the steps of immersing said tips in a nail tip removal solution, providing ultrasonic vibration to said solution to agitate said solution and maintain said solution at slightly above room temperature, and manipulating said nail tips against a surface.

* * * * *